US005435787A

United States Patent [19]

Ratcliffe

[11] Patent Number: 5,435,787

[45] Date of Patent: Jul. 25, 1995

[54] DEVICES

[75] Inventor: Michael S. Ratcliffe, Pudsey, England

[73] Assignee: Fine Art Developments PLC, Bradford, England

[21] Appl. No.: 90,161

[22] PCT Filed: Jan. 29, 1992

[86] PCT No.: PCT/GB92/00162

§ 371 Date: Aug. 2, 1993

§ 102(e) Date: Aug. 2, 1993

[87] PCT Pub. No.: WO92/13770

PCT Pub. Date: Aug. 20, 1992

[30] Foreign Application Priority Data

Feb. 2, 1991 [GB] United Kingdom ..... 9102325

[51] Int. Cl.[6] ..... A63H 5/00

[52] U.S. Cl. ..... 472/56; 229/102

[58] Field of Search ..... 472/56, 53; 40/455, 40/539; 229/102; 206/459.1; 446/398, 901, 486

[56] References Cited

U.S. PATENT DOCUMENTS

| | | | |
|---|---|---|---|
| 2,111,179 | 3/1938 | Dillard | 472/56 |
| 3,798,806 | 3/1974 | Sanford | 40/28.1 |
| 3,878,641 | 4/1975 | Noble | 46/175 |
| 4,607,747 | 8/1986 | Steiner | 206/232 |

FOREIGN PATENT DOCUMENTS

| | | |
|---|---|---|
| 0174913 | 3/1986 | European Pat. Off. . |
| 0253003 | 1/1988 | European Pat. Off. . |
| 729679 | 5/1955 | United Kingdom . |
| 1168276 | 10/1969 | United Kingdom . |
| 2137560 | 3/1984 | United Kingdom . |

OTHER PUBLICATIONS

WO, A, 8 501 448, published Apr. 11, 1985.

*Primary Examiner*—Carl D. Friedman
*Assistant Examiner*—Kien T. Nguyen
*Attorney, Agent, or Firm*—Nikaido, Marmelstein, Murray & Oram

[57] ABSTRACT

A novelty device forms from a cube-shaped container in which a gift may be disposed. The container includes opposite walls (**4*b*,4*d*) extending upwardly so as to define respective tabs (8,9) each of which is folded back on itself to define tab parts (8*a*, 8*b* and 9*a*, 9*b*). A snap is connected between the tabs (8, 9) and extends within the container. In use, an operator grasps tabs (8, 9**) and urges them apart. In doing so, the container opens to reveal the gift and the snap emits a sharp, explosive sound.

18 Claims, 10 Drawing Sheets

DEVICES

FIELD OF THE INVENTION

This invention relates to novelty devices.

SUMMARY OF THE INVENTION

According to one aspect of the present invention, a novelty device comprises a container arranged to be opened by at least one wall of the container moving outwardly relative to the container and sound producing means arranged to emit a sound when the container is opened.

The container may be arranged to be opened by at least one wall of the container moving outwardly relative to the container about a hinge or, more preferably, about a fold. The hinge or fold is preferably provided between a base part of the container (which base part is preferably substantially flat) and the at least one wall. The at least one wall is preferably an upwardly extending wall. The wall is preferably substantially planar. Preferably, the container is arranged to be opened by two or more walls of the container moving outwardly relative to the container about a hinge or fold. At least two of the walls are preferably opposite to one another.

The sound producing means may be arranged to emit a sound by commencement of movement of at least one wall outwardly, or during movement of at least one wall outwardly.

The container may be of any suitable size and shape. Preferably, it comprises a single hollow region. In a preferred embodiment, it comprises a hollow substantially cube-shaped structure. It may comprise a triagonal pyramidical structure or a hexagonal structure.

The volume occupied by the container suitably represents at least 50% of the volume of the novelty device. Preferably, the volume occupied represents greater than about 75% of the novelty device. More preferably, the volume occupied represents greater than 90%. The volume occupied is suitably greater than 95%. The volume occupied by the container is preferably substantially equal to the volume occupied by the novelty device.

Preferably, the container is constructed from a self-supporting material, for example, from card or stiffened paper. The material preferably includes a decorative finish. The material may, for example, be foil-coated card. Preferably, the container is made from a single sheet of the self-supporting material by folding the material in a suitable fashion; that is, preferably each part of the container is an integral part (not a subsequently attached part) of a sheet of the self-supporting material. The container may be held together partially or completely simply by the interengagement of adjacent parts. The self-supporting material may be arranged so as to form the container and be held in position by adhesive means or by means of one or more tabs of the container engaging in slots provided in other parts of the container.

The device may include a first part and a second part arranged to be moved apart by an operator thereby to open the container and those parts may be gripped by an operator. The first part is suitably fixed to or adjacent to a first side of the container or is an integral part of the container. The second part is suitably fixed to or adjacent to a second side of the container or is an integral part of the container. The first part may be fixed to or adjacent to a first inside wall of the container. Alternatively or additionally, the first part may extend to a small extent through the first inside wall, for example, it may extend through a slot therein, into which slot it may be secured. The second part may be fixed to or adjacent to a second inside wall of the container. Alternatively or additionally, the second part may extend to a small extent through the second inside wall, for example, it may extend through a slot therein, in which it may be secured. The second part of the device preferably comprises a user-operable operating member which may be, for example, a piece of string. The user-operable operating member suitably is disposed, in part, outside the container. Alternatively, the first and second parts of the opening means may comprise tab members which are, preferably, integral parts of the container outside the outline of the container structure and which may be used to open the container.

The first and second parts of the device are preferably directly connected to one another by a connecting member. The connecting member preferably includes a sound producing strip of the sound producing means. The connecting member may, alternatively or additionally, include a piece of string or like material. The connecting member may comprise a piece of string or like material fixed to a sound producing strip, the arrangement being fixed between the first and second parts. When provided, preferably, the sound producing strip is hidden from view, preferably within the container or, when provided, is substantially hidden by the tab members which are outside the outline of the container.

The sound producing means for producing a sound is suitably arranged to produce a sharp sound. It is suitably arranged to be remotely actuated and is preferably substantially totally enclosed within the container. The means may comprise a percussion cap. Suitably, the means comprises two thin strips which are joined together and a percussion cap arranged so that when the strips are urged apart, the percussion cap, produces a sharp sound. The means suitably comprise a member known as a "snap".

Preferably, the sound producing means produces the sound substantially at the same time as the container is opened.

The container, after opening, may be arranged to be closed again by moving at least one wall inwardly. The container may be arranged such that it is not destroyed when opened. It may be re-usable, at least in part. For example, only the sound production means may need replacing. The novelty device is suitably arranged such that, when fully open, it may assume a substantially flat structure.

Preferably, the novelty device further comprises novelty items, for example, within the container. The novelty items are preferably removable from the novelty device when the container has been opened. The device may be arranged so as to be opened without the sound producing means producing the sound so that a person may place items of his/her choice within the device.

The novelty device may further comprise information display means, suitably on an upstanding wall of the device, for displaying a person's name. The device may further comprise fixing means for hanging the device from a fixed structure, for example, from the branch of a Christmas tree. The fixing means may be provided by the piece of string of the aforementioned connecting member or by other suitable means.

According to another aspect of the invention, there is provided a novelty device having a substantially flat first surface, the device including a first part fixed so as to be disposed at or adjacent the first surface, the first part being moveable relative to the first surface, the device further including sound producing means arranged to produce a sound when the first part is moved relative to the first surface.

The first part may be fixed adjacent printed matter on the first surface. The printed matter may define, with the first part, an object, for example, a cracker. The device may include a second part fixed so as to be disposed at or adjacent to the first surface, and the first part may be connected to the second part.

Preferably, the first part is arranged to slide relative to the first surface or second part. The sound producing means may be as described in any of the preceding statements. The second part may be directly fixed to the surface. The first part is suitably disposed adjacent the second part. The first part suitably fits through a slot and is preferably attached to one end of the sound producing means. The sound producing means is suitably fixed, at its other end, to a second surface, opposite the first surface.

The first part may be arranged to reveal matter otherwise hidden, when it is moved relative to the second part. For example, when the first part is moved a motto may be revealed. Alternatively or additionally, the novelty device may further comprise matter, for example, a motto, which is initially hidden, user-operable means being provided for revealing the hidden matter. The user-operable means may include a perforated window.

According to a further aspect of the present invention a novelty device comprises a first part moveable relative to a second part with movement of the first part relative to the second part being arranged to cause sound producing means to produce a sound and to reveal a previously concealed information bearing portion previously concealed by one of the parts. At least one and preferably both of the parts are substantially flat.

The aforementioned novelty devices may include a greetings card. Preferably, where provided, the first surface, the first part and the second part are disposed substantially in the same plane.

DESCRIPTION OF THE DRAWINGS

Specific embodiments of the invention, will now be described, by way of example, with reference to the accompanying diagrammatic drawings in which.

DESCRIPTION OF THE PREFERRED EMBODIMENTS

Figure 1A:
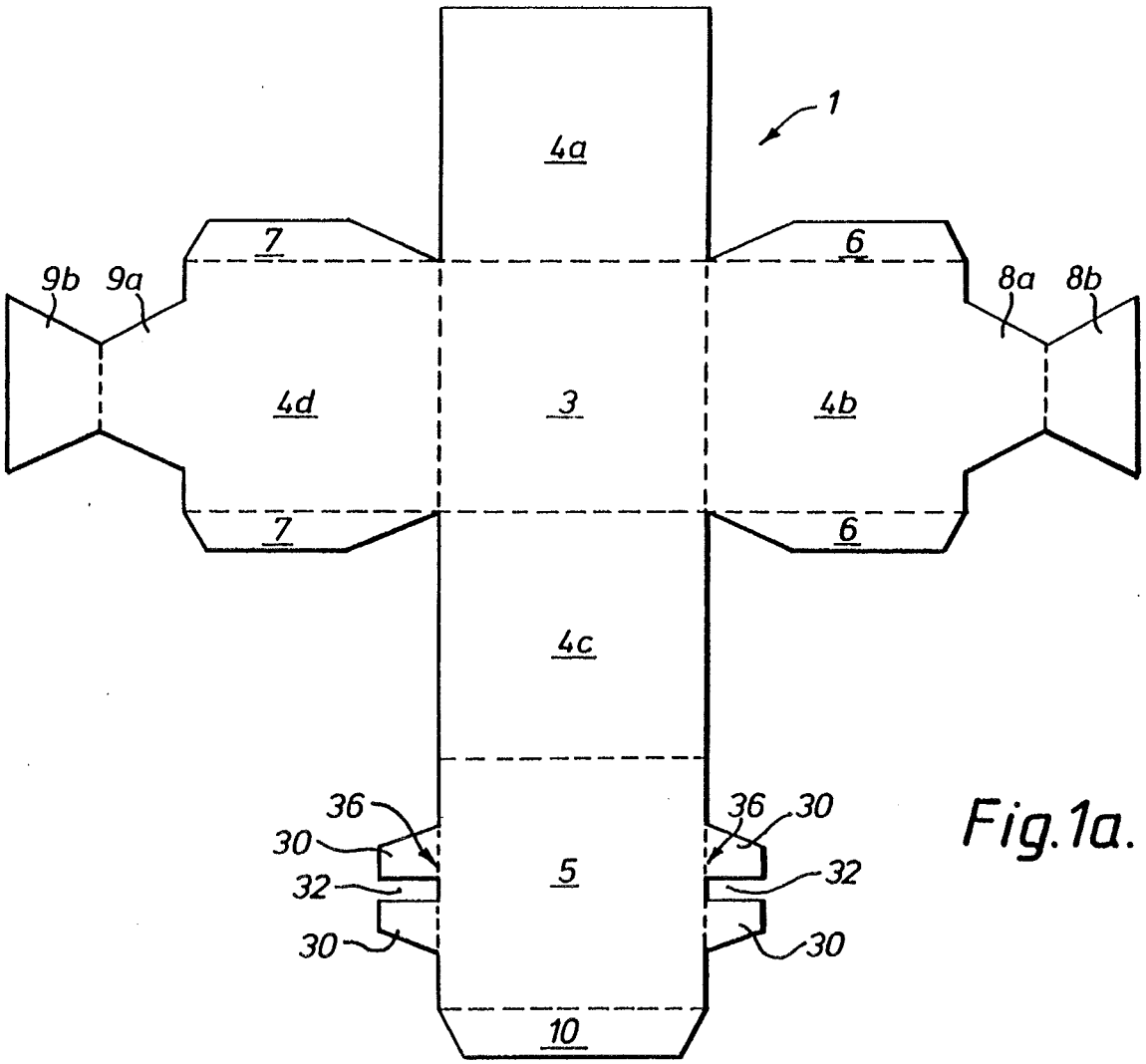
FIG. 1*a* is a plan view of a piece of card arranged for assembly of a novelty device.
Figure 1B:
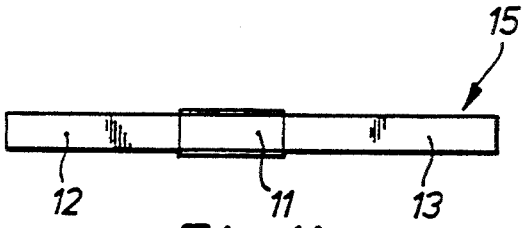
FIG. 1*b* a plan view of a "snap"
Figure 1C:
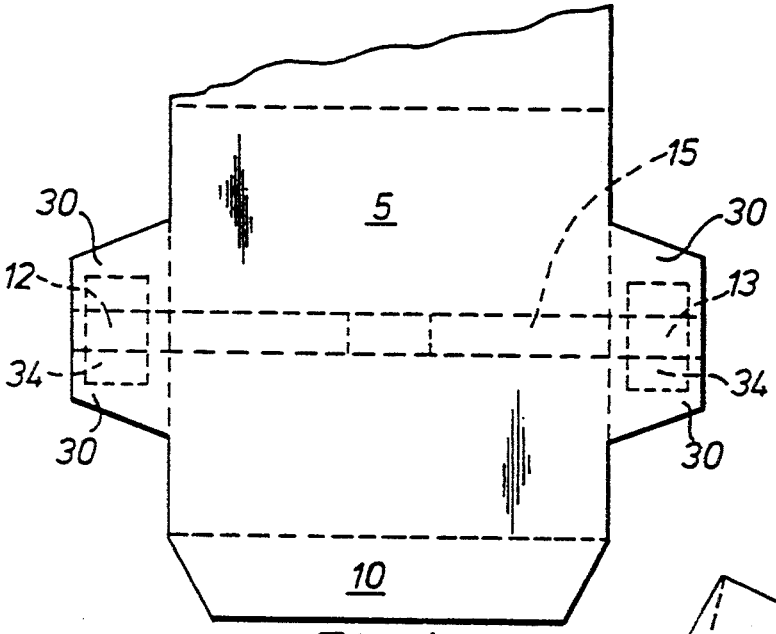
FIG. 1*c* shows the snap attached to a part of the piece of card of the novelty device, shown in FIG. 1*a;*
Figure 1D:
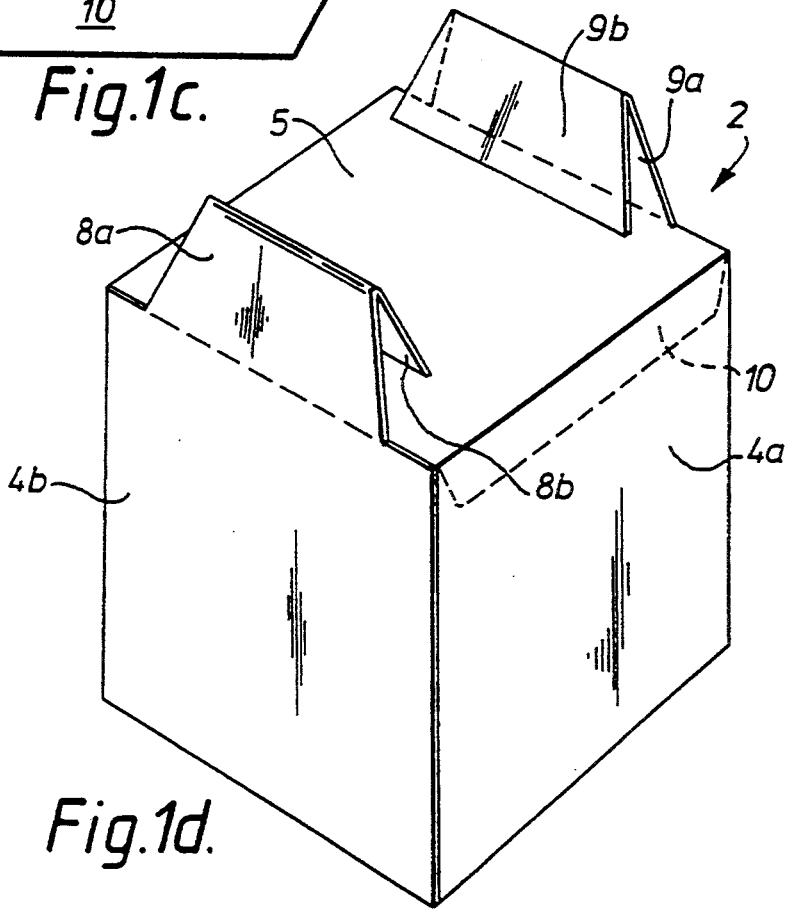
FIGS. 1*d*, 1*e* and 1*f* are respectively a perspective view, a side elevation from one side and a side elevation from another side of the assembled novelty device.
Figure 1E:
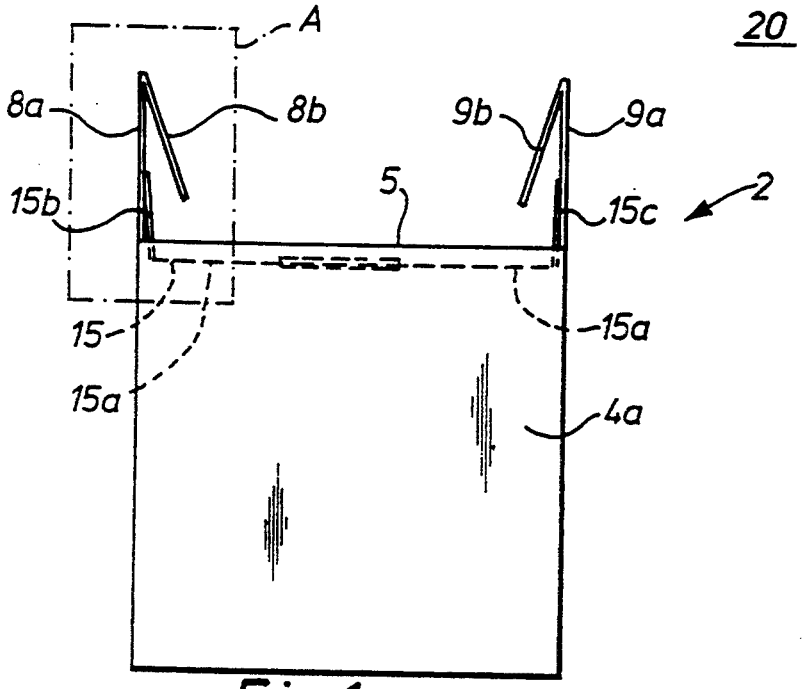
Figure 1G:
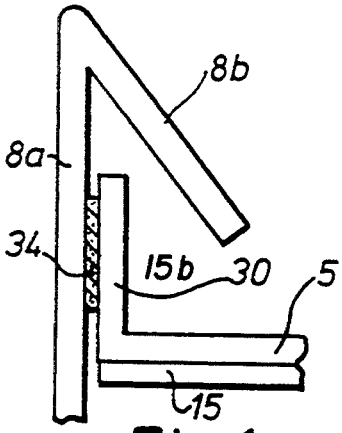
FIG. 1*g* side elevation of the part within box "A" in FIG. 1*e* with the dimensions exaggerated in the interests of clarity.
Figure 1F:
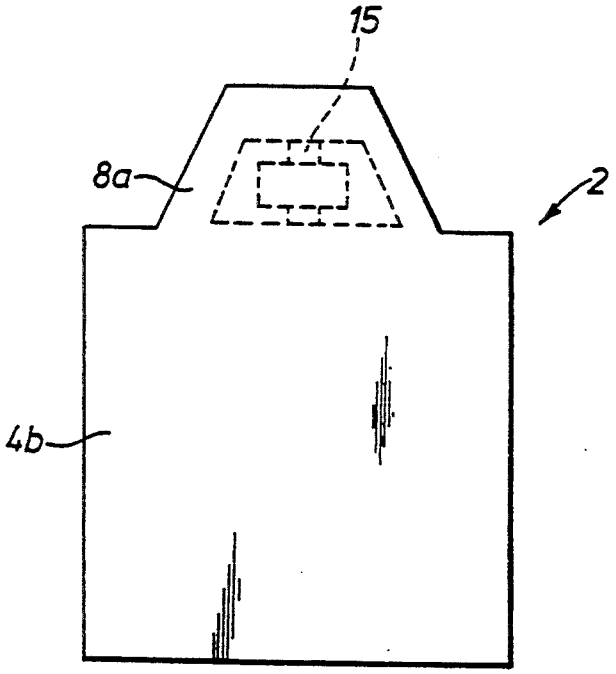

A novelty device 20, shown in FIGS. 1*d* to *f* is made from a single piece of card i, shown in FIG. 1*a*, which card 1 has fold lines shown in dashed lines, between which are defined parts of a cube-shaped box 2 shown in FIGS. 1*d* to *f*.

The piece of card 1 (FIG. 1*a*) comprises a base 3, four sides **4*a*–4*d* and a top 5. Sides 4*b* and 4*d* include two support flaps 6, 7 respectively. In addition, sides 4*b* and 4*d* are extended outwardly by means of tabs 8, 9, each of which includes tab parts a and b. A top support flap 10 extends from the top 5. A pair of trapezial-shaped lugs 30 are provided on two, opposite sides of the top 5 so that two respective parallel sided slots 32 are defined adjacent to each of the opposite sides. The lugs are perforated along respective fold lines 36**.

A "snap" 15, shown in FIG. 1*b*, is made of thin card and comprises an explosive material in region 11. Parts 12, 13 of the snap 15 may be pulled apart, whereupon the explosive material emits a sharp sound.

The parts 12, 13 of the snap are fixed within the respective slots 32, with the snap underneath the top 5 of the piece of card 1. In this respect pieces 34 of double-sided sticky tape are stuck to the underside surfaces (as seen in FIG. 1*c* and 1*g*) of the lugs 30 and parts 12, 13 of the snap.

The snap 15 is disposed generally within the cube-shaped structure when it is in the assembled state, as shown in FIG. 1*e*, *f* and *g*. More particularly, a part **15*a* of the snap is disposed directly below and parallel to the top 5 of the device 20, and parts 15*b* and 15*c* are bent upwardly along with the respective parts of lugs 30 between which they are disposed. The double-sided sticky tape 34 is then used to secure respective pairs of lugs 30 and parts 15*b*, 15*c* to the tabs 8*a*, 9*a* respectively. When so disposed, the parts 15*b* and 15*c* of the snap 15 are hidden, to some extent, below the respective tab parts 8*b*, 9*b***.

The novelty device may be assembled as follows. The snap 15 is initially fixed, using one sticky side of the pieces 34 of double-sided sticky tape, between the respective pairs of lugs 30, so as to be arranged as represented in FIG. 1*c*. Then, the sides **4*a*–4*d* of the piece of card 1 are folded upwardly so as to be perpendicular to base 3. Flaps 6, 7 are folded inwardly so as to be perpendicular to side 4*b*, 4*d* and are arranged within adjacent sides 4*a*, 4*c*. The top 5 is folded downwardly perpendicular to side 4*c* and in turn the flap 10 is folded downwardly perpendicular to top 5. A novelty item is placed within the box to be formed. The flap 10 of the top 5 is then glued to the inside of the top of side 4*a*. The other sticky side of the pieces 34 of double-sided sticky tape is then stuck to the inside of tab parts 8*a*, 9*a*** (see FIG. 1*g*). Finally, tab parts **8*b*, 9*b*, are folded so as robe disposed at an acute angle to respective tab parts 8***a*, 9*a* to hide snap 15.

The novelty device may be given as a gift. It may include a label indicating a person's name and may then be placed at a dining table to indicate the seat at which the person should sit.

In use, a person grasps tabs 8*a*and 8*b* of device 20 between the fingers of one hand; tabs 9*a* and 9*b* are grasped between fingers of the other hand. The tabs 8, 9, are pulled apart which results in the lugs 30 being broken away from the top 5 along their respective perforated fold lines 36 with parts of the snap attached thereto. Accordingly, the parts 12, 13 of the snap 15 are urged apart so that a sharp sound is emitted and, in turn, the box 2 is pulled apart to reveal the novelty item therein.

Figure 1H:
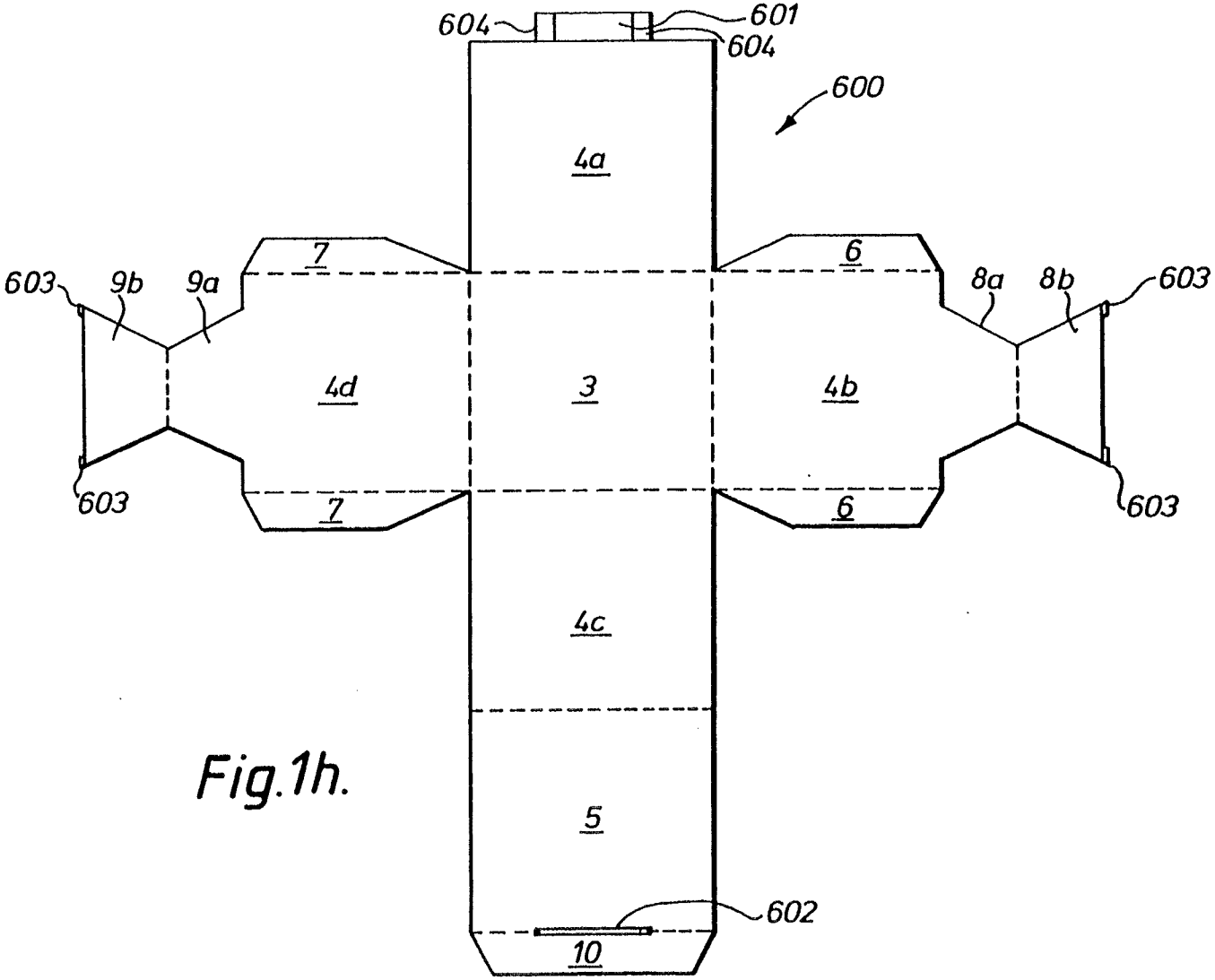
FIG. 1*h* is a plan view showing a piece of card of a device similar to that of FIG. 1*a;*

The novelty device 600 shown in FIG. 1*h* is the same as that shown in FIG. 1*a* to 1*g* except for the following. The device 600 includes a rectangular tab 601, attached to side 4*a*, the tab 601 having hinged parts 604. A slot 602 is provided between top 5 and flap 10. In addition, locking tabs 603 are provided at spaced locations on respective tab parts 8*b*, 9*b*. To form a cube-shaped structure, tab 601 is disposed at right angles to side 4*a* and is inserted within slot 602. Hinged parts 604 are then folded inwardly to hold the structure together. Tab part 603 fit underneath top 5 so that respective parts 8*b*, 9*b* are disposed substantially parallel to respective parts 8*a*, 9*a*. The locking tabs 603 may engage in a gap defined between the top 5 and the sides 4*b*, 4*d* for holding the tab parts 8*b* 9*b* parallel to tab parts 8*a*, 9*a*.

Figure 2A:
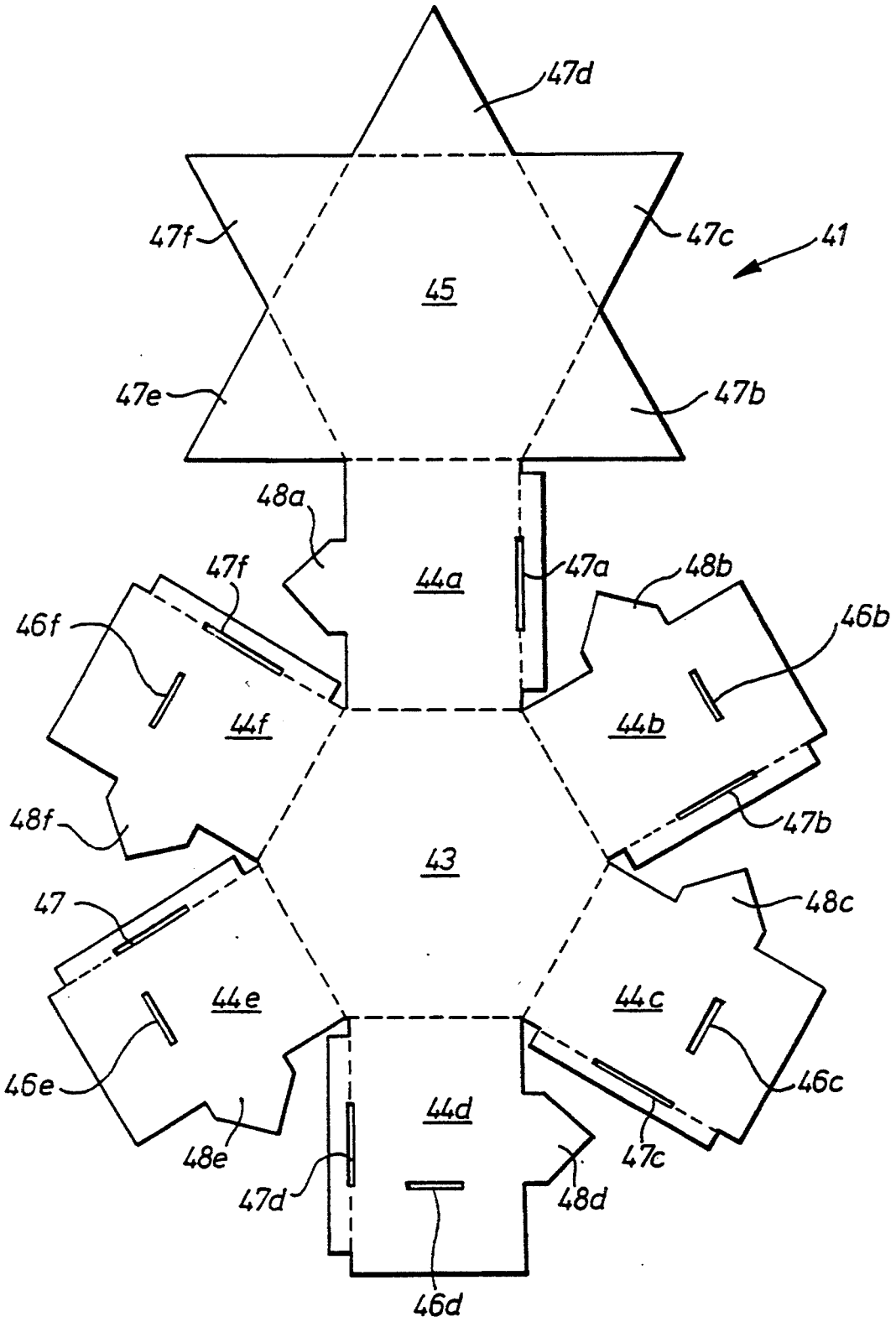
FIG. 2*a* is a plan view of a piece of card arranged for the assembly of another novelty device.
Figure 2B:
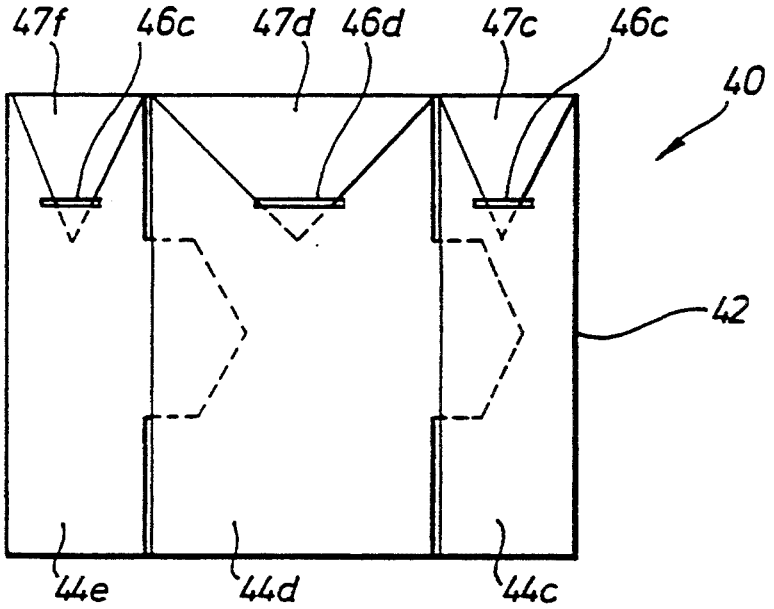
FIG. 2*b* is a detailed side elevation of the assembled device of FIG. 2*a*, partly in cross-section.
Figure 2C:
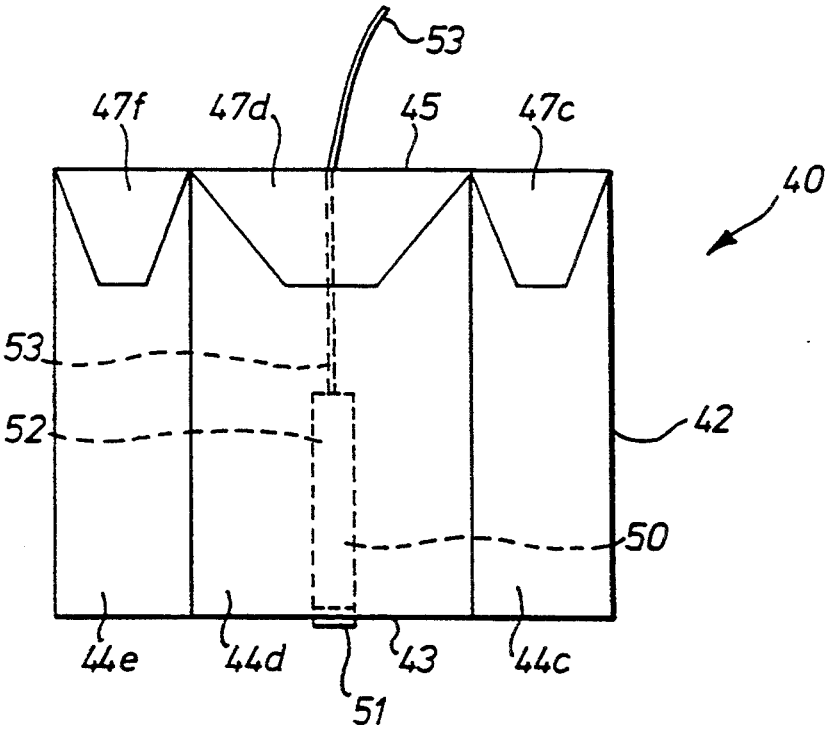
FIG. 2*c* is a less detailed side elevation of the assembled device of FIG. 2*a*, partly in cross-section.

A novelty device 40 shown in FIGS. 2*b* and 2*c* is made from a single piece of card 41 as shown in FIG. 2*a* which card 41 has fold lines shown in dashed lines between which are defined parts of an hexagonal box 42, shown in FIGS. 2*b* and 2*c*.

The piece of card 41 comprises a base 43, six sides 44*a*–f, and a top 45. Sides 44*b*–44*f* include a slot 46 therein into which respective tabs 47, extending from the top 45, are fitted, when assembled. Each side 44 includes a slot 47, into which a respective tab 48 on an adjacent side is fitted when assembled.

A snap 50 (FIG. 2*c*) is fixed within the hexagonal box 42. In this regard, one end 51 of the snap 50 fits through a slot (not shown) in the center of the base 43 of the box 42. The other end 52 of the snap is fixed to a piece of string 52 which, in turn, is pushed through a hole (not shown) in the center of the top 45 of the box 42.

Assembly of the novelty device 40 comprises folding sides 44 upwardly so as to be perpendicular to base 43; then respective tabs 48 are fitted into adjacent respective slots 47 to hold the sides in position. The snap 51 is fixed in base 43 and string 53 fitted through the center of top 45. A novelty item is placed within the box to be formed. The top 45 is then closed and respective tabs 47 are engaged within respective slots 46 in sides 44.

In use, a person holds box 40 adjacent base 43 thereof and pulls string 53 outwardly. As a consequence the snap emits a sharp sound and, since part of the snap, too large to fit through the hole, is pulled against the top 45, the box opens to reveal the novelty item.

Figure 3A:
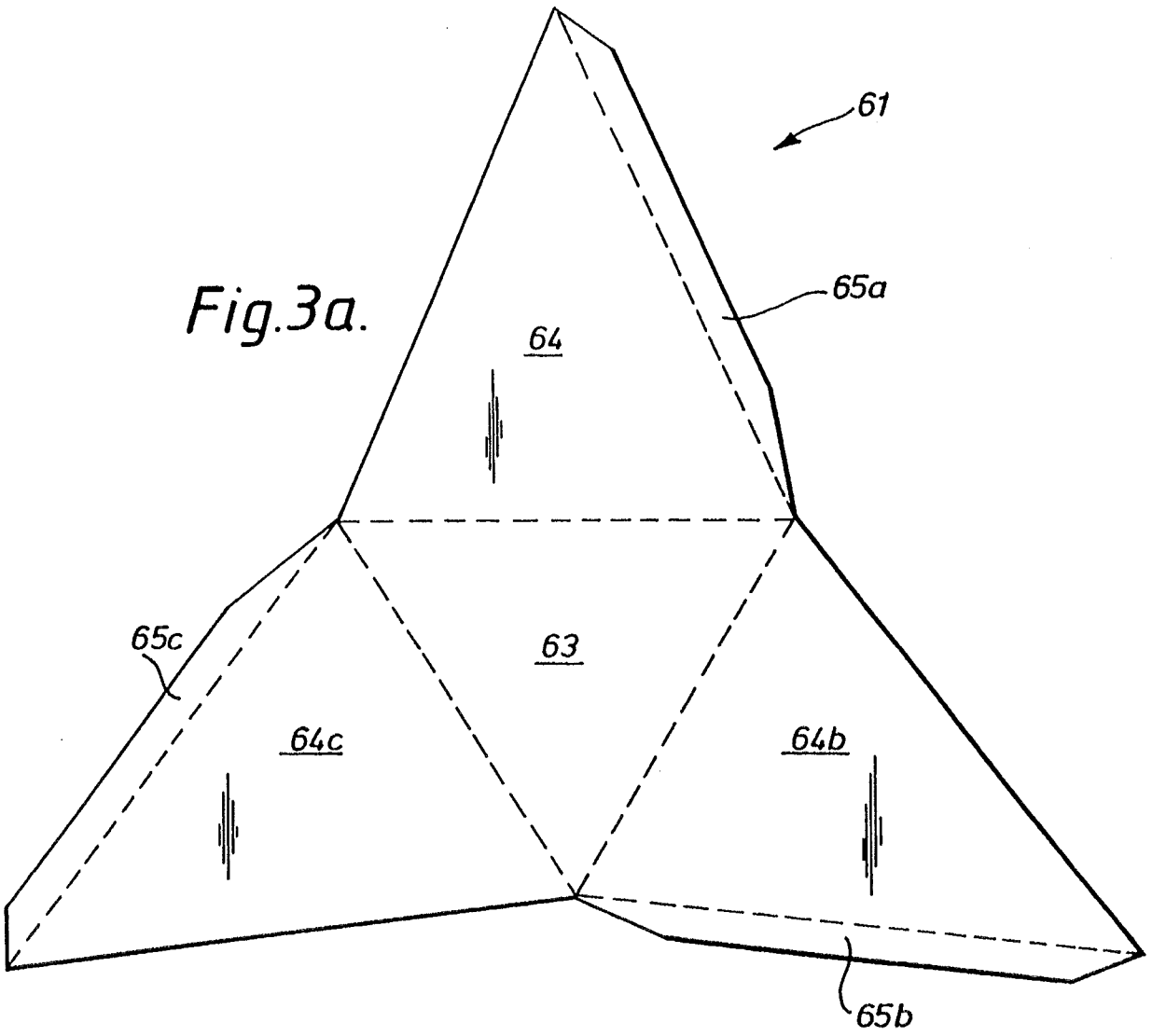
FIG. 3*a* is a plan view of a piece of card arranged for the assembly of another novelty device.
Figure 3B:
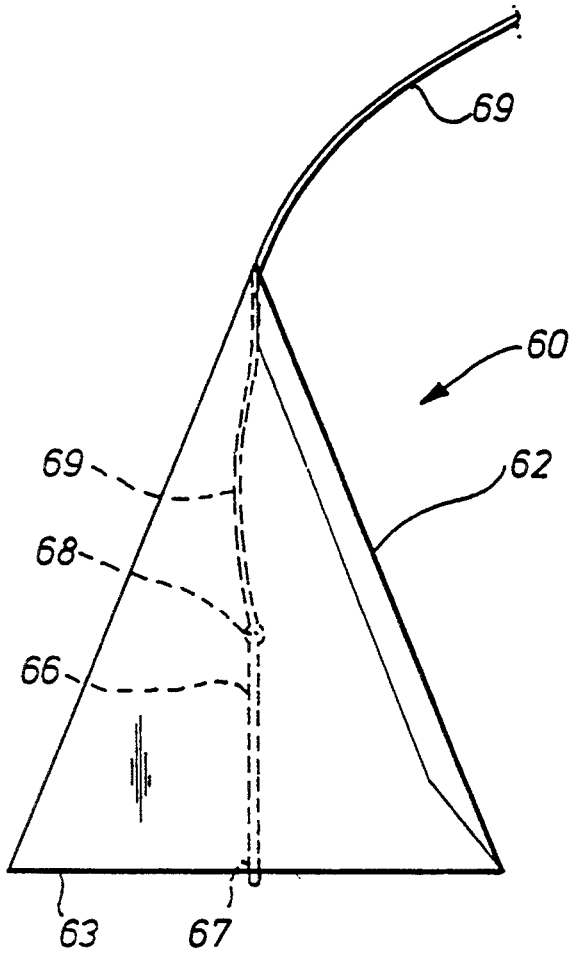
FIGS. 3*b* and 3*c* are a side view, partly in cross-section, and a perspective view of the novelty device of FIG. 3*a* respectively.
Figure 3C:
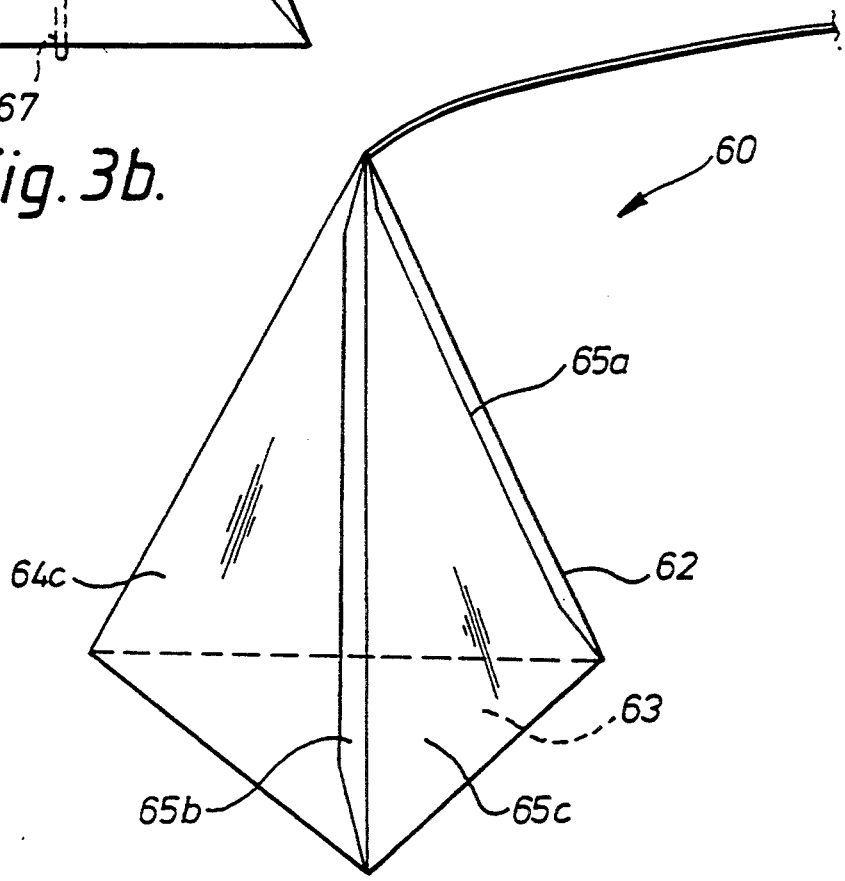

The novelty device 60, shown in FIGS. 3*b* and 3*c*, is made from a single piece of card 61, as shown in FIG. 3*a*, which card 61 has fold lines shown in dashed lines between which lines are defined part of a pyramidical box 62, shown in FIG. 3*b* and 3*c*.

The piece of card 61 comprises a base 63 and three sides 64*a*–*c*. Each of the sides 64 includes a securement flap 65.

A snap 66 is fixed within the pyramidical box 62, as shown in FIG. 3*b*. In this regard, one end 67 of the snap 66 fits through a slot (not shown) in the center of base 63 of the box 60, in which slot it is secured by means of adhesive tape. The other end 68 of the snap 66 is fixed to a piece of string 69 which, in turn, fits between the sides 64*a*–*c at their point of intersection.*

Assembly of the novelty device 60 comprises folding sides 64 upwardly so that the sides intersect. The snap 68 and string 69 are fixed in position. A novelty item is placed within the box 62 to be formed. Flaps 65 are then folded inwardly about 60°. The flaps 65 are arranged such that each flap 65 (e.g. flap 65*b*) overlies a respective adjacent side (e.g. side 64*c*). As a consequence, no additional means for the securing the arrangement is required.

In use, a person holds box 60 adjacent base 63 thereof and pulls the string 69 outwardly. Consequentially, the snap emits a sharp sound and the box opens to reveal the novelty item.

The aforementioned novelty devices may be fixed by means of a piece of string, for example, by string 53, 69, in the respective FIGS. 2 and 3 embodiments to, for example, a branch of a Christmas tree. Alternatively, they may be used simply as attractive means of presenting a gift.

The novelty devices are decorated in an attractive manner. For example, card from which devices are made be coated with coloured foil. A decorative ribbon may be fixed to a side of the device.

Any of the aforementioned novelty devices may be arranged such that a person, for example, a purchaser, may insert into the box their own gift. That is, a purchaser may customize his/her own device. In this regard the FIG. 2 and 3 embodiments may be of particular utility since no adhesive means is used to hold the box in its assembled state. The FIG. 1 embodiment may include, in addition to the features on show, an additional securable flap in the base or other suitable position.

The device of some of the embodiments may not be destroyed when opened. Thus, the devices may be reused. Device may be made in any desirable shape or size.

Figure 4B:
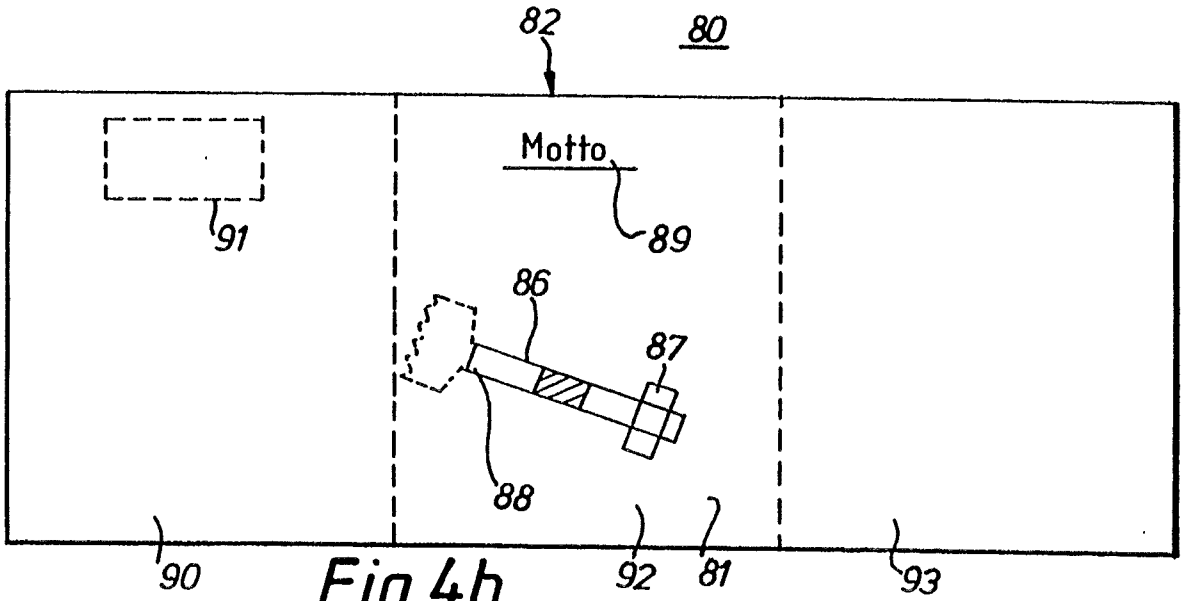
FIG. 4*a* and 4*b* are side elevations of a further novelty device.
Figure 4A:
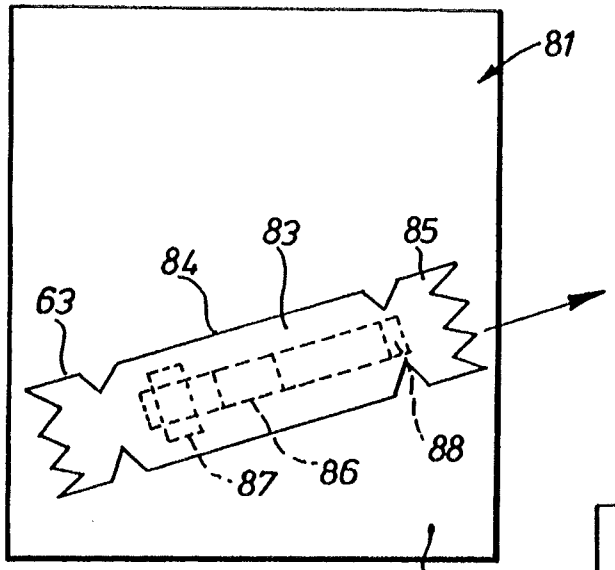

A novelty device 80, shown in FIGS. 4, is in the form of a greetings card having leaves 90, 92 and 93. Leaf 92 has a front face 81 (FIG. 4*a*). The dashed lines in FIG. 4*b* represent fold lines of the card.

Referring to FIG. 4*a*, a representation of a cracker 83 is shown. This cracker is in two parts. A first part 84 comprises a piece of card stuck on the front face. A second part 85, forms one end of the cracker. It is made out of card and is arranged to be pulled away from part 84 in a longitudinal direction relative thereto. The part 85 fits through a slot 88 in leaf 92 and is attached to a snap 86 fixed to the rear face 81 (FIG. 4*b*) by means of adhesive tape 87 so that when the part 85 is pulled the "snap" is actuated to give a shard sound.

A motto 89 is printed on the rear face 81. The leaf 90 of the greetings card includes a perforated rectangular panel 91.

The greetings card may be assembled by inserting part 85 through slot 88, fixing part 85 to snap 86 and securing the snap in position by,means of tape 87. Then leaf 90 is folded over face 90 of leaf 92 and glued in this position. Thus, leaves 90 and 92 appear to be a single component which defines the greetings card along with leaf 83.

In use, the part 85 may be pulled by a recipient of the device 80 to produce a shard sound. The motto may be revealed by removing panel 91.

Figure 5B:
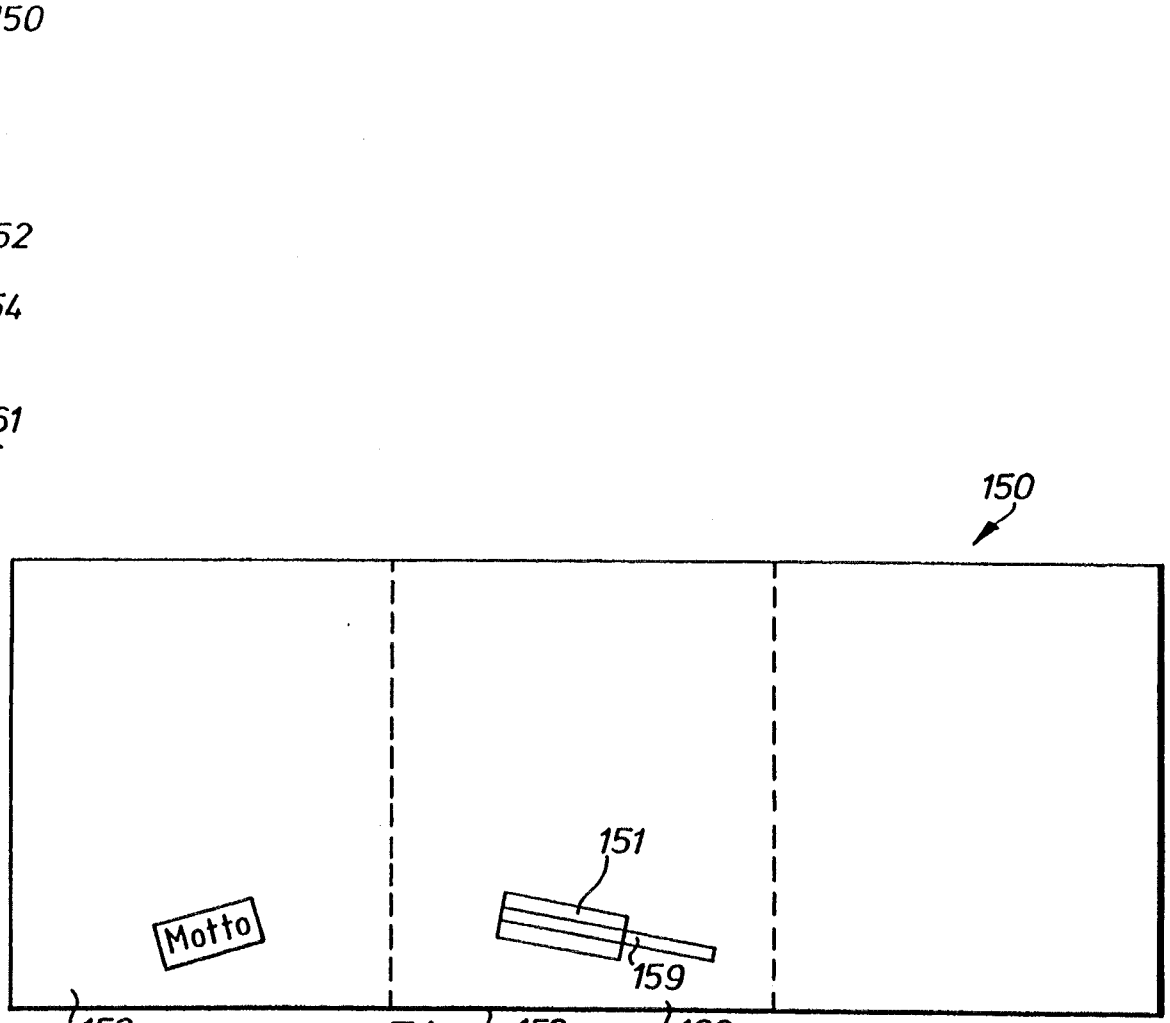
FIGS. 5*a* and 5*b* are side elevations of a further novelty device similar to the FIG. 4 embodiment.
Figure 5A:
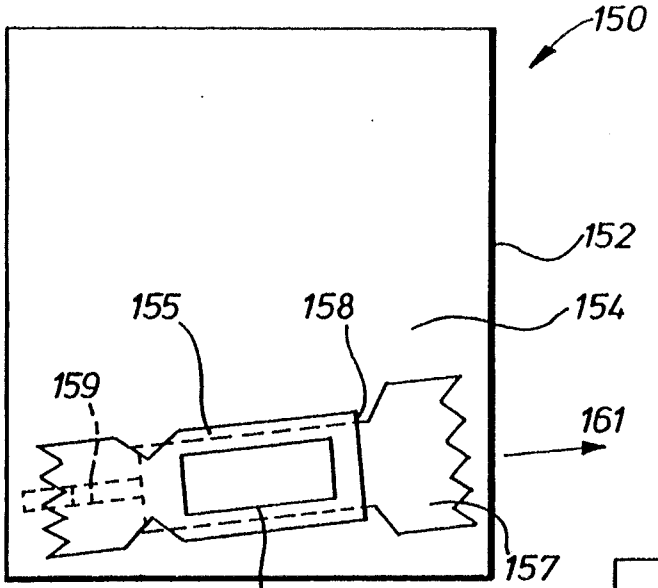

In another embodiment shown in FIGS. 5*a* and *b*, a novelty device 150 is in the form of a greetings card as described above. In this case, however, a rectangular slot 151 is provided in a leaf 152. The slot 151 is arranged such that a motto provided on one side of leaf 153 fits therewithin when leaves 152,153 are stuck to one another. A front side 154 of leaf 152 includes a cardboard cracker first part 155 which is stuck over the slot 151 so as to provide an open end slot 158. The part 155 has a cut-out portion 156 of the same size as and, in use, superimposed upon slot 151. A cardboard, cracker second part 157 fits into open end slot 158 and is longitudinally slidable relative to part 155. The part 157 is thereby longitudinally slidable relative to part 155. The part 157 is attached to a snap 159 which is secured to side 160 of leaf 152.

In use, the part 157 is pulled in the direction of arrow 161, the snap 159 produces a sharp sound and the motto is revealed within the cut out portion 156.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A novelty device comprising:

a base and a plurality of walls arranged to define a container, said container arranged to be opened by at least one wall of the container moving outwardly relative to said base about a hinge or fold;

a user-operable operating member disposed, in part, outside an outline of the container for opening the container; and a percussive sound producing means being provided and arranged for emitting a percussive sound when the container is opened.

2. A device according to claim 1, wherein said hinge or fold is provided between said base of the container and said at least one wall.

3. A device according to claim 1, wherein said wall which is arranged to move outwardly is substantially planar.

4. A device according to claim 1, wherein the container is arranged to be opened by two or more walls of the container moving outwardly relative to said lease about a hinge or fold.

5. A device according to claim 1, wherein said sound producing means is arranged to emit a sound by commencement of movement of at least one wall outwardly, or during movement of at least one wall outwardly.

6. A device according to claim 1, wherein the container comprises a single hollow region.

7. A device according to claim 1, wherein the container comprises a hollow substantially cube-shaped structure.

8. A device according to claim 1, wherein the volume occupied by said container suitably represents at least 50% of the volume of said novelty device.

9. A device according to claim 1, wherein the volume occupied by said container is substantially equal to the volume occupied by said novelty device.

10. A device according to claim 1, wherein the container is constructed from self-supporting material.

11. A device according to claim 1, wherein the container is made from a single sheet of self-supporting material by folding the material in a suitable fashion.

12. A novelty device according to claim 1, wherein the user operable operating member is operatively connected to the percussive sound producing means.

13. A novelty device according to claim 1, wherein the percussive sound producing means is fixed between two opposing parts of the container.

14. A novelty device according to claim 1, wherein said user-operable operating member is arranged to be moved outwardly to open the container.

15. A device according to claim 1, wherein the user-operable operating member of the device includes a first part and a second part arranged to be moved apart by an operator thereby to open the container.

16. A device according to claim 15, wherein the first and second parts comprise tab members which are integral parts of the device outside the outline of a hollow part of the container structure.

17. A device according to claim 15, wherein the first and second parts are directly connected to one another by a connecting member.

18. A device according to claim 17, wherein said connecting member includes a sound producing strip of said sound producing means.

* * * * *

UNITED STATES PATENT AND TRADEMARK OFFICE

CERTIFICATE OF CORRECTION

PATENT NO. : 5,435,787

DATED : July 25, 1995

INVENTOR(S) : RATCLIFFE

It is certified that error appears in the above-indentified patent and that said Letters Patent is hereby corrected as shown below:

Title page, [54], before "DEVICES" insert --NOVELTY--.

Signed and Sealed this

Twenty-third Day of January, 1996

*Attest:*

Bruce Lehman

BRUCE LEHMAN

*Attesting Officer*

*Commissioner of Patents and Trademarks*